US011509086B2

(12) United States Patent
Li et al.

(10) Patent No.: US 11,509,086 B2
(45) Date of Patent: Nov. 22, 2022

(54) ELECTRICAL CONNECTOR

(71) Applicant: Tyco Electronics (Shanghai) Co. Ltd., Shanghai (CN)

(72) Inventors: Xinxin Li, Shanghai (CN); Tongbao Ding, Shanghai (CN); Zebin Tang, Shanghai (CN); Weiguo Li, Shanghai (CN); Liming Wang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 17/177,590

(22) Filed: Feb. 17, 2021

(65) Prior Publication Data

US 2021/0257764 A1 Aug. 19, 2021

(30) Foreign Application Priority Data

Feb. 19, 2020 (CN) ..... 202020185670.6

(51) Int. Cl.
*H01R 13/20* (2006.01)
*H01R 13/11* (2006.01)
*H01R 4/18* (2006.01)

(52) U.S. Cl.
CPC ..... *H01R 13/20* (2013.01); *H01R 13/113* (2013.01); *H01R 4/185* (2013.01)

(58) Field of Classification Search
CPC ..... H01R 13/20; H01R 13/113; H01R 4/185
USPC ..... 439/867
See application file for complete search history.

(56) References Cited

U.S. PATENT DOCUMENTS 3,771,111 A * 11/1973 Pritulsky ..... H01R 43/058 439/850
4,298,243 A * 11/1981 Swengel, Jr. ..... H01R 13/115 439/730
4,679,887 A * 7/1987 Jackson ..... H01R 13/20 439/849
5,160,279 A * 11/1992 Sagawa ..... H01R 13/422 439/595
5,344,348 A * 9/1994 Willis ..... H01R 13/115 439/849
5,800,220 A * 9/1998 Feeny ..... H01R 13/113 439/849
6,527,600 B2 * 3/2003 Alonso Merino ... H01R 13/113 439/842
6,997,746 B2 * 2/2006 Taylor ..... H01R 4/183 439/585
7,198,526 B1 * 4/2007 MacNeil ..... H01R 4/185 439/881
7,255,614 B1 * 8/2007 Irish ..... H01R 13/113 439/849
9,306,301 B2 * 4/2016 Shimoji ..... H01R 12/75
9,692,163 B1 * 6/2017 Didonato ..... H01R 13/506
10,027,037 B2 * 7/2018 Didonato ..... H01R 13/20
10,079,440 B1 * 9/2018 Didonato ..... H01R 13/115
10,193,259 B1 * 1/2019 Didonato ..... H01R 13/40
(Continued)

*Primary Examiner* — Peter G Leigh
(74) *Attorney, Agent, or Firm* — Barley Snyder

(57) ABSTRACT

An electrical connector includes a main body portion having a receiving passage adapted to receive a plate-type plug inserted in an insertion direction, and a locking protrusion formed on the main body portion and protruding toward the receiving passage. The locking protrusion has a connection portion adapted to connect a top portion of the locking protrusion with the main body portion downstream in the insertion direction.

20 Claims, 3 Drawing Sheets

(56) References Cited

U.S. PATENT DOCUMENTS

| | | | | |
|---|---|---|---|---|
| 10,211,558 | B1 * | 2/2019 | Didonato | H01R 13/432 |
| 2001/0002350 | A1 * | 5/2001 | Kashiyama | H01R 13/11 439/848 |
| 2006/0292937 | A1 * | 12/2006 | Morello | H01R 13/113 439/856 |
| 2018/0013212 | A1 * | 1/2018 | Didonato | H01R 13/113 |
| 2018/0034179 | A1 * | 2/2018 | Hashiguchi | H01R 13/187 |
| 2018/0294589 | A1 * | 10/2018 | Humphrey | H01R 13/11 |
| 2019/0288427 | A1 * | 9/2019 | Pan | H01R 13/115 |
| 2019/0372261 | A1 * | 12/2019 | Pan | H01R 4/185 |

* cited by examiner

ELECTRICAL CONNECTOR

CROSS-REFERENCE TO RELATED APPLICATION

This application claims the benefit of the filing date under 35 U.S.C. § 119(a)-(d) of Chinese Patent Application No. 202020185670.6, filed on Feb. 19, 2020.

FIELD OF THE INVENTION

The present disclosure relates to an electrical connector and, more particularly, to a socket connector electrically connected with a plate-type plug.

BACKGROUND

In an existing socket connector electrically connected with a plate-type plug, the socket connector has a locking protrusion to be matched with a locking hole in the plate-type plug. When the plate-type plug is inserted into the socket connector and connected with the socket connector, the locking protrusion is inserted into the locking hole of the plate-type plug in a direction perpendicular to the insertion direction, thereby preventing the plate-type plug from being detached from the socket connector.

Because the locking protrusion is formed by a stamping process, however, an end of the locking protrusion in contact with the plate-type plug is disconnected from a base for forming the locking protrusion. A created locking force is insufficient during pulling out the plate-type plug, or can result in damage to the locking protrusion.

SUMMARY

An electrical connector includes a main body portion having a receiving passage adapted to receive a plate-type plug inserted in an insertion direction, and a locking protrusion formed on the main body portion and protruding toward the receiving passage. The locking protrusion has a connection portion adapted to connect a top portion of the locking protrusion with the main body portion downstream in the insertion direction.

BRIEF DESCRIPTION OF THE DRAWINGS

The invention will now be described by way of example with reference to the accompanying Figures, of which.

DETAILED DESCRIPTION OF THE EMBODIMENTS

Figure 1:
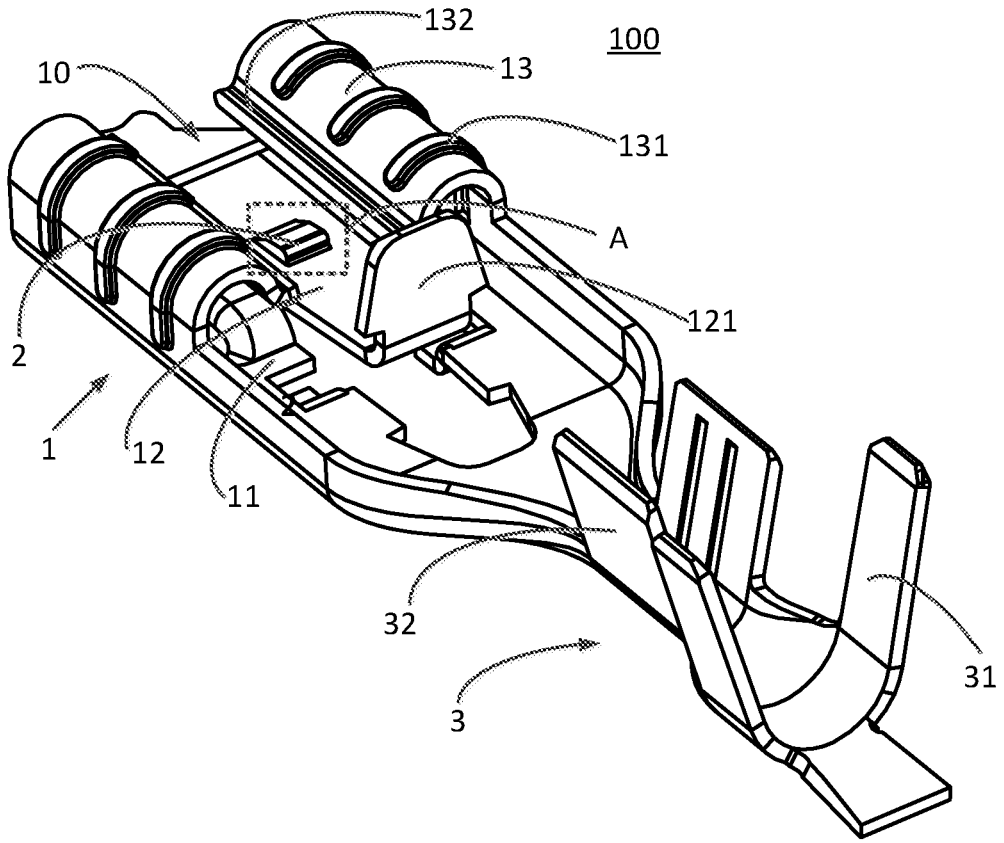
FIG. 1 is a perspective view of an electrical connector according to an embodiment.

The technical solution of the disclosure will be described hereinafter in further detail with reference to the following embodiments, taken in conjunction with the accompanying drawings. In the description, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

An electrical connector 100 according to an embodiment, as shown in FIGS. 1-4, comprises a main body portion 1 formed with a receiving passage 10 adapted to receive a plate-type plug 200 inserted in an insertion direction D, and a locking protrusion 2 formed on the main body 1 and protruding toward the receiving passage 10. The locking protrusion 2 has a connection portion 21 adapted to connect a top portion 23 of the locking protrusion 2 with the main body portion 1 downstream in the insertion direction D.

Figure 2:
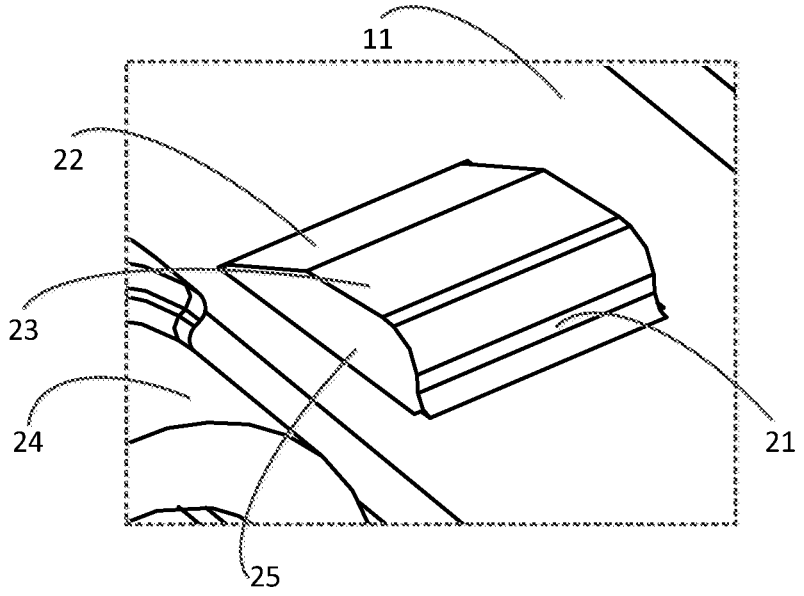
FIG. 2 is an enlarged view of a part A of FIG. 1.
Figure 3:
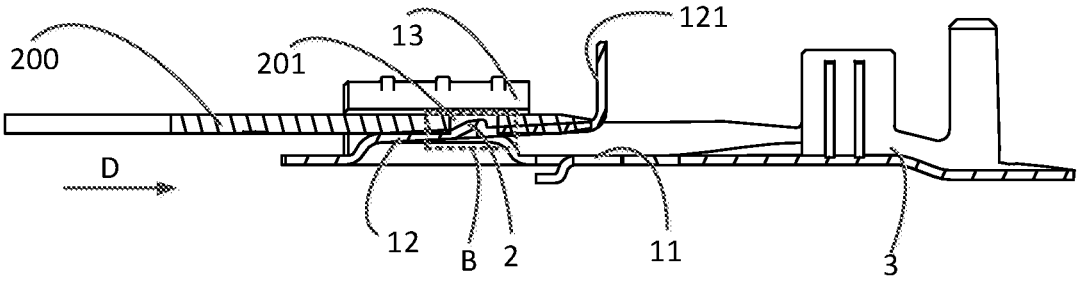
FIG. 3 is a sectional side view of the electrical connector connected to a plate-type plug.
Figure 4:
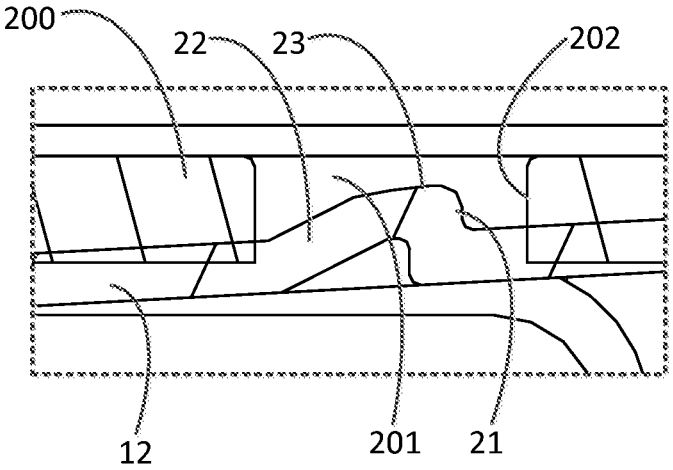
FIG. 4 is an enlarged view of a part B of FIG. 3.

During insertion of the plate-type plug 200 into the receiving passage 10 of the electrical connector 100, as shown in FIGS. 1-4, a front end of the plate-type plug 200 firstly slides over the top portion 23 of the locking protrusion 2, and then the locking protrusion 2 is inserted into a locking hole 201 of the plate-type plug 200. In this case, if the plate-type plug 200 moves outwardly, the locking protrusion 2 is abutted against a front edge 202 of the locking hole 201, as shown in FIG. 4, thereby preventing the plate-type plug 200 from being pushed out from the electrical connector 100.

Because the connection portion 21, shown in FIGS. 2 and 4, is configured to connect the top portion 23 of the locking protrusion 2 with the main body portion 1 downstream in the insertion direction D, a locking force of the locking protrusion 2 is increased. Further, the locking protrusion 2 is not easily rolled backwards due to a pulling force exerted by the plate-type plug 200, thereby preventing the locking protrusion 2 from being damaged.

In an embodiment, as shown in FIGS. 1 and 2, at least one of two side portions 25 of the locking protrusion 2 extending parallel to the insertion direction D is disconnected from the main body portion 1. In other words, the side portions 25 of the locking protrusion 2 are not connected with the main body portion 1. In this way, the locking protrusion 2 is easily deformed due to pressing of the plate-type plug 200, so that the locking protrusion 2 has elasticity.

The locking protrusion 2, as shown in FIGS. 2 and 4, has an inclined portion 22 extending obliquely to the top portion 23 from the main body portion 1 in the insertion direction D. That is, a surface of the locking protrusion 2 upstream in the insertion direction D is inclined. In this way, when the plate-type plug 200 is inserted into the receiving passage 10 of the electrical connector 100, the inclined portion 22 of the locking protrusion 2 may guide the sliding of the front end of the plate-type plug 200.

As shown in FIGS. 1-3, the main body portion 1 has a substantially flat bottom portion 11 and a cantilever 12 formed on the bottom portion 11 and extending in the insertion direction D. The locking protrusion 2 is formed on the cantilever 12. In this way, as the plate-type plug 200 is inserted into the receiving passage 10 of the electrical connector 100 and the front end of the plate-type plug 200 slides over the top portion 32 of the locking protrusion 2, the plate-type plug 200 presses the cantilever 12 to bias downward by the locking protrusion 2, so that the plate-type plug 200 may be inserted into the receiving passage 10 smoothly.

It should be understood that the locking protrusion 2 may be formed by a stamping process after the two side portions 25 of the locking protrusion 2 are firstly cut out on the flat bottom portion 11 of the main body 1. Thereafter, the cantilever 12 is formed on the bottom portion 11 by shearing and stamping processes.

In an embodiment, as shown in FIGS. 1 and 3, a free end of the cantilever 12 (the right end in FIG. 3) is formed as a blocking portion 121 extending in a direction substantially perpendicular to the insertion direction D and adapted to block further insertion of the plate-type plug 200.

As shown in FIGS. 1 and 3, the main body portion 1 has a pair of holding arms 13 bending toward each other on both sides of the bottom portion 11 in parallel with the insertion direction D, and an end edge of each of the holding arms 13 extending parallel to the insertion direction D is spaced apart from the bottom portion 11 so that the receiving passage 10 is defined by the two holding arms 13 and the bottom portion 11. Each of the holding arms 13 is formed with a plurality of ribs 131 to increase an elasticity of the holding arms 13. The end edge of each of the holding arms 13 is formed as an arc-shaped portion 132 protruding toward the bottom portion 11. The arc-shaped portion 132 is in elastic contact with the plate-type plug 200 so that the plate-type plug 200 is electrically connected to the electrical connector 100 reliably.

In an exemplary embodiment of the disclosure, as shown in FIGS. 1 and 3, a fix portion 3 adapted to be electrically connected with a cable is provided downstream of the main body portion 1 in the insertion direction D. The fix portion 3 includes a mechanical connection portion 31 and an electrical connection portion 32. The mechanical connection portion 31 is adapted to fix a protective layer of the cable partially un-peeled off to firmly connect the cable to the electrical connector 100. The electrical connection portion 32 is provided between the mechanical connection portion 31 and the main body portion 1 and configured to be electrically connected with wires of the cable, thereby achieving electrical connection between the cable and the electrical connector 100.

The plate-type plug 200 may be electrically connected to another cable so as to realize a quick electrical connection of two cables. In an alternative embodiment of the disclosure, the plate-type plug 200 may be connected with a plurality of cables.

In the electrical connector 100, because the connection portion 21 is configured to connect the top portion 23 of the locking protrusion 2 and the main body portion 1 downstream in the insertion direction D, the locking force of the locking protrusion 2 is increased. The electrical connector 100 may be formed by a single metal plate such as a copper sheet through machining processes such as shearing, stamping, and bending process, and thus has a simple and compact structure.

In a case where the metal plate has a thickness of about 0.25 mm, the locking force of the locking protrusion 2 of the electrical connector 100 is 132 N after a simulated mechanical analysis is made to the electrical connector 100. Compared with the electrical connector with the locking protrusion in a suspended state on the downstream side, the locking force of the locking protrusion 2 of the electrical connector 100 according to the embodiments of the disclosure can be increased by 93.9%.

In a case where the metal plate has a thickness of about 0.25 mm, the locking force of the locking protrusion 2 of the electrical connector 100 is 111 N after a plurality of mechanical tests are made to the electrical connector 100 according to the embodiments of the disclosure. Compared with the electrical connector with the locking protrusion in a suspended state on the downstream side, the average locking force of the locking protrusion 2 of the electrical connector 100 of the embodiments of the disclosure can be increased by 88%.

It should be appreciated by those skilled in this art that the above embodiments are intended to be illustrative, and many modifications may be made to the above embodiments by those skilled in this art. Further, various structures described in various embodiments may be freely combined with each other without conflicting in configuration or principle. Although the disclosure has been described hereinbefore in detail with reference to the attached drawings, it should be appreciated that the disclosed embodiments in the attached drawings are intended to illustrate the embodiments of the disclosure by way of example, and should not be construed as limitation to the disclosure. Although a few embodiments of the general inventive concept of the disclosure have been shown and described, it would be appreciated by those skilled in the art that changes or modification may be made to these embodiments without departing from the principles and spirit of the general inventive concept, the scope of which is defined in claims and their equivalents.

What is claimed is:

1. An electrical connector, comprising:

a main body portion having:

a receiving passage adapted to receive a plate-type plug inserted in an insertion direction;

a bottom portion; and a pair of holding arms formed by bending toward each other two sides of the bottom portion in parallel with the insertion direction, each of the holding arms having a plurality of ribs; and a locking protrusion formed on the main body portion and protruding toward the receiving passage, the locking protrusion has a connection portion adapted to connect a top portion of the locking protrusion with the main body portion downstream in the insertion direction.

2. The electrical connector of claim 1, wherein at least one of a pair of side portions of the locking protrusion extending parallel to the insertion direction is disconnected from the main body portion.

3. The electrical connector of claim 2, wherein the locking protrusion has an inclined portion extending obliquely to the top portion in the insertion direction.

4. The electrical connector of claim 1, wherein the bottom portion is substantially flat.

5. The electrical connector of claim 4, wherein the main body portion has a cantilever formed on the bottom portion and extending in the insertion direction.

6. The electrical connector of claim 5, wherein the locking protrusion is formed on the cantilever.

7. The electrical connector of claim 6, wherein a free end of the cantilever is formed as a blocking portion extending in a direction substantially perpendicular to the insertion direction.

8. The electrical connector of claim 1, further comprising a fix portion provided downstream of the main body portion in the insertion direction, the fix portion is adapted to be electrically connected with a cable.

9. The electrical connector of claim 8, wherein the fix portion includes a mechanical connection portion adapted to fix a protective layer of the cable.

10. The electrical connector of claim 9, wherein the fix portion includes an electrical connection portion provided between the mechanical connection portion and the main body portion and configured to be electrically connected with a plurality of wires of the cable.

11. The electrical connector of claim 1, wherein the connection portion is formed integrally with the main body portion downstream in the insertion direction.

12. An electrical connector, comprising:

a main body portion having a receiving passage adapted to receive a plate-type plug inserted in an insertion direction; and a locking protrusion formed on the main body portion and protruding toward the receiving passage, the locking protrusion has a connection portion continuously and uninterruptedly connecting a top portion of the locking protrusion with the main body portion downstream in the insertion direction.

13. The electrical connector of claim 12, wherein the connection portion is formed integrally with the main body portion downstream in the insertion direction.

14. The electrical connector of claim 12, wherein the connection portion extends downwardly from the top portion to the main body portion, the connection portion having a thickness in the insertion direction at least equal to a thickness of another portion of the locking protrusion in a vertical direction.

15. The electrical connector of claim 12, wherein each of a pair of side portions of the locking protrusion extend linearly and parallel to the insertion direction, and are disconnected from the main body portion.

16. An electrical connector, comprising:

a main body portion having a receiving passage adapted to receive a plate-type plug inserted in an insertion direction, and a cantilever formed on a bottom portion of the main body and extending in the insertion direction; and a locking protrusion formed on the main body portion and protruding toward the receiving passage, the locking protrusion including:

an inclined portion extending obliquely from the cantilever in the insertion direction, the inclined portion formed integrally with the cantilever upstream in the insertion direction;

a top portion formed integrally with the inclined portion; and a connection portion formed integrally with both the top portion and the cantilever downstream in the insertion direction.

17. The electrical connector of claim 16, wherein the main body portion has a pair of holding arms formed by bending toward each other on both sides of a bottom portion of the main body portion in parallel with the insertion direction.

18. The electrical connector of claim 17, wherein an end edge of each of the holding arms extending parallel to the insertion direction is spaced apart from the bottom portion so that the receiving passage is defined by the holding arms and the bottom portion.

19. The electrical connector of claim 18, wherein each of the holding arms has a plurality of ribs.

20. The electrical connector of claim 18, wherein the end edge of each of the holding arms has an arc-shaped portion protruding toward the bottom portion.

* * * * *